US005247790A

United States Patent [19]

Donlan et al.

[11] Patent Number: 5,247,790

[45] Date of Patent: Sep. 28, 1993

[54] GAS TURBINE FUEL NOZZLE WITH REPLACEABLE CAP

[75] Inventors: John P. Donlan; Jeffrey C. Eddy, both of Oviedo, Fla.

[73] Assignee: Westinghouse Electric Corp., Pittsburgh, Pa.

[21] Appl. No.: 946,691

[22] Filed: Sep. 18, 1992

[51] Int. Cl.[5] ..... F23R 3/36

[52] U.S. Cl. ..... 60/39.32; 60/39.55; 60/742

[58] Field of Search ..... 60/740, 742, 39.55, 60/39.32, 39.31

[56] References Cited

U.S. PATENT DOCUMENTS

| | | | |
|---|---|---|---|
| 2,618,928 | 11/1952 | Nathan | 60/742 |
| 2,701,164 | 2/1955 | Purchas, Jr. et al. | 60/742 |
| 3,091,926 | 6/1963 | Watkins | 60/742 |
| 3,302,399 | 2/1967 | Tini et al. | 60/740 |
| 3,488,949 | 1/1970 | Jackson | 60/39.32 |
| 4,258,544 | 3/1981 | Gebhart et al. | 60/39.32 |
| 4,409,791 | 10/1983 | Jourdaini et al. | 60/39.32 |
| 4,850,196 | 7/1989 | Scalzo et al. | 60/740 |

*Primary Examiner*—Richard A. Bertsch
*Assistant Examiner*—Timothy S. Thorpe

[57] ABSTRACT

A gas turbine fuel nozzle assembly having a replaceable nozzle cap. The nozzle assembly is comprised of a base portion and a nozzle cap. The nozzle base is secured to a combustion system and contains inlet ports for receiving either gas and oil fuel or gas fuel and steam, depending on the nozzle assembly configuration. The nozzle cap has outlet ports for injecting either gas and oil fuel or gas fuel and steam. The nozzle cap is connected to the nozzle base by inner and outer sleeves that form an annular conduit by which the gas flows from an inlet port in the base to an outlet port in the cap. In addition, the inner sleeve, which has an expansion joint formed therein, forms a central cavity that either holds an oil spray nozzle or forms a steam passage, depending on the nozzle assembly configuration. The nozzle cap is detachably coupled to the base by first and second threaded joints formed in the inner and outer sleeves, respectively. A locknut presses a front portion of the outer sleeve against a rear portion of the outer sleeve to form a first secure, but detachable, joint. A lock tube pulls a front portion of the inner sleeve against a rear portion of the inner sleeve to form a second secure, but detachable, joint. Anti-rotation pins and seals are disposed in both the first and second joints.

19 Claims, 2 Drawing Sheets

GAS TURBINE FUEL NOZZLE WITH REPLACEABLE CAP

BACKGROUND OF THE INVENTION

The present invention relates to fuel nozzles for gas turbines. More specifically, the present invention relates to a fuel nozzle assembly having a replaceable nozzle cap.

Gas turbines include a combustion system having one or more combustors adapted to produce a hot gas by burning a fuel in compressed air. A fuel nozzle assembly is employed to introduce the fuel into each combustor.

Traditionally, a fuel nozzle is comprised of a base portion and a nozzle cap. The base portion has an inlet port that receives the fuel to be burned and that secures the fuel nozzle assembly to the combustion system, either by bolting to the combustor itself or to a cylinder enclosing the combustors. The nozzle cap features fuel outlet ports that serve to inject the fuel into the combustor. Typically, the nozzle cap extends from the nozzle base so as to enter into the combustor. Because of the proximity of the nozzle cap to the flame front and the hot combustion gases within the combustor, the nozzle caps are subject to deterioration due to burning, erosion and corrosion. Consequently, the nozzle caps must be replaced relatively frequently.

Since gas turbines can operate on a variety of fuels, including both liquid and gaseous fuels, and may require the injection of steam into the combustor to minimize the formation of NOx, an environmental pollutant, modern fuel nozzle assemblies must be capable of introducing two fluids into the combustor. Thus, to facilitate rapid switching from one fuel to another, fuel nozzle assemblies are often manufactured in a "dual fuel" configuration—thereby avoiding the necessity of changing nozzles when changing fuels. In addition, fuel nozzle assemblies are also manufactured in a gas/steam configuration for emissions control.

As a result of the requirement that the fuel nozzle assembly be capable of introducing two different fluids in the combustor, modern fuel nozzle assemblies have relatively complex internal passages. Typically, inner and outer sleeves connect the nozzle cap to the base and form an annular passage therebetween that directs the gas fuel from the inlet port formed in the nozzle base to the outlet port formed in the nozzle cap. In addition, the inner sleeve forms a central cavity therewithin that houses an oil spray nozzle, in the case of dual fuel gas/oil nozzle assembly, or that forms a passage that directs steam from an inlet port formed in the nozzle base to an outlet port formed in the nozzle cap, in the case of a gas/steam nozzle assembly. As a result of this complex geometry, in the traditional arrangement, the nozzle base and cap were manufactured as parts of a unitary cast or welded structure.

As a result of this unitary structure, replacement of the nozzle cap requires machining the old nozzle cap from the base and welding on a new cap. This work demands specialized tooling and trained personnel. Consequently, it is necessary to transport the nozzles to an off-site repair facility. The need to remove the nozzles from the power plant considerably increases the cost and downtime associated with maintenance of the combustion system and represents a maintenance problem for the user.

It is therefore desirable to provide a fuel nozzle assembly for a gas turbine that is capable of burning more than one fuel, or burning gaseous fuel along with injecting steam, and that allows the nozzle cap to be readily separated from the nozzle body so that nozzle cap replacement can be readily performed by the user.

SUMMARY OF THE INVENTION

Accordingly, it is the general object of the current invention to provide a fuel nozzle assembly for a gas turbine that is capable of burning more than one fuel, or burning gaseous fuel along with injecting steam, and that allows the nozzle cap to be readily separated from the nozzle body so that nozzle cap replacement can be readily accomplished by the user.

Briefly, this object, as well as other objects of the current invention, is accomplished in a gas turbine, comprising (i) a compressor for producing compressed air, (ii) a combustion system for heating the compressed air by fuel therein, thereby producing a heated compressed gas, (iii) a fuel nozzle assembly for introducing fuel into the combustion system, and (iv) a turbine for expanding the heated compressed gas from the combustor assembly. The fuel nozzle assembly has (i) a nozzle base having means for securing the nozzle assembly to the combustion system, (ii) a nozzle cap having a first fluid outlet port formed therein for injecting a fluid into the compressed air and inner and outer rearwardly extending sleeves, and (iii) means for coupling and uncoupling the nozzle base from the nozzle cap, the coupling means having first and second means for attaching and detaching the nozzle base from the inner and outer sleeves, respectively.

In the preferred embodiment of the invention, the inner sleeve has means for accommodating differential thermal expansion between the inner and outer sleeves and the first and second attaching and detaching means comprise first and second threaded members, respectively. The first threaded member has means for pulling the inner sleeve against the nozzle base and the second threaded member has means for pressing the outer sleeve against the nozzle base. In addition, the coupling and uncoupling means comprises means for preventing rotation of the nozzle cap relative to the nozzle base as well as first and second seals disposed between the nozzle cap and the inner and outer sleeves, respectively.

DESCRIPTION OF THE PREFERRED EMBODIMENT

Figure 1:
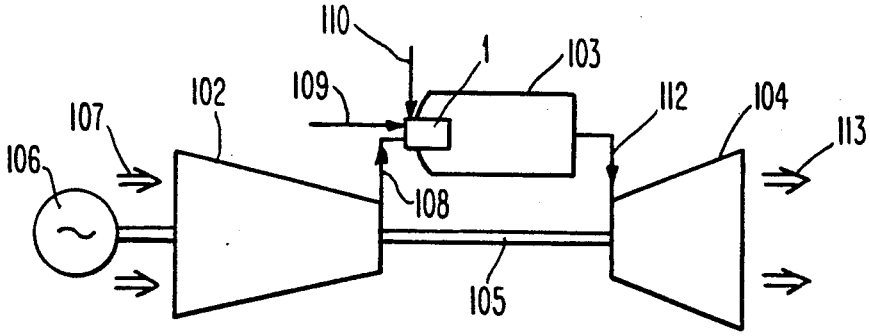
FIG. 1 is a schematic diagram of a gas turbine.

Referring to the drawings, there is shown in FIG. 1 a schematic diagram of a gas turbine 1. The gas turbine 1 is comprised of a compressor 102 that is driven by a turbine 104 via a shaft 105. Ambient air 107 is drawn into the compressor 108 and compressed. The compressed air 108 produced by the compressor 102 is directed to a combustion system that includes one or more combustors 103, a fuel nozzle assembly 1 for each combustor, and a cylinder 53 (shown in phantom in FIG. 2) that encloses the combustors. In the combustors 103, the fuel 109 is burned in the compressed air 108, thereby producing a hot compressed gas 112. The fuel 109 may be a liquid, such as no. 2 distillate oil, or a gas, such as natural gas, and is introduced into the combustor 103 by the fuel nozzle assembly 1.

The hot compressed gas 112 produced by the combustor 103 is directed to the turbine 104 where it is expanded, thereby producing shaft horsepower for driving the compressor 102, as well as a load, such as an electric generator 106. The expanded gas 103 produced by the turbine 104 is exhausted, either to the atmosphere directly or, in a combined cycle plant, to a heat recovery steam generator and then to atmosphere.

Figure 2:
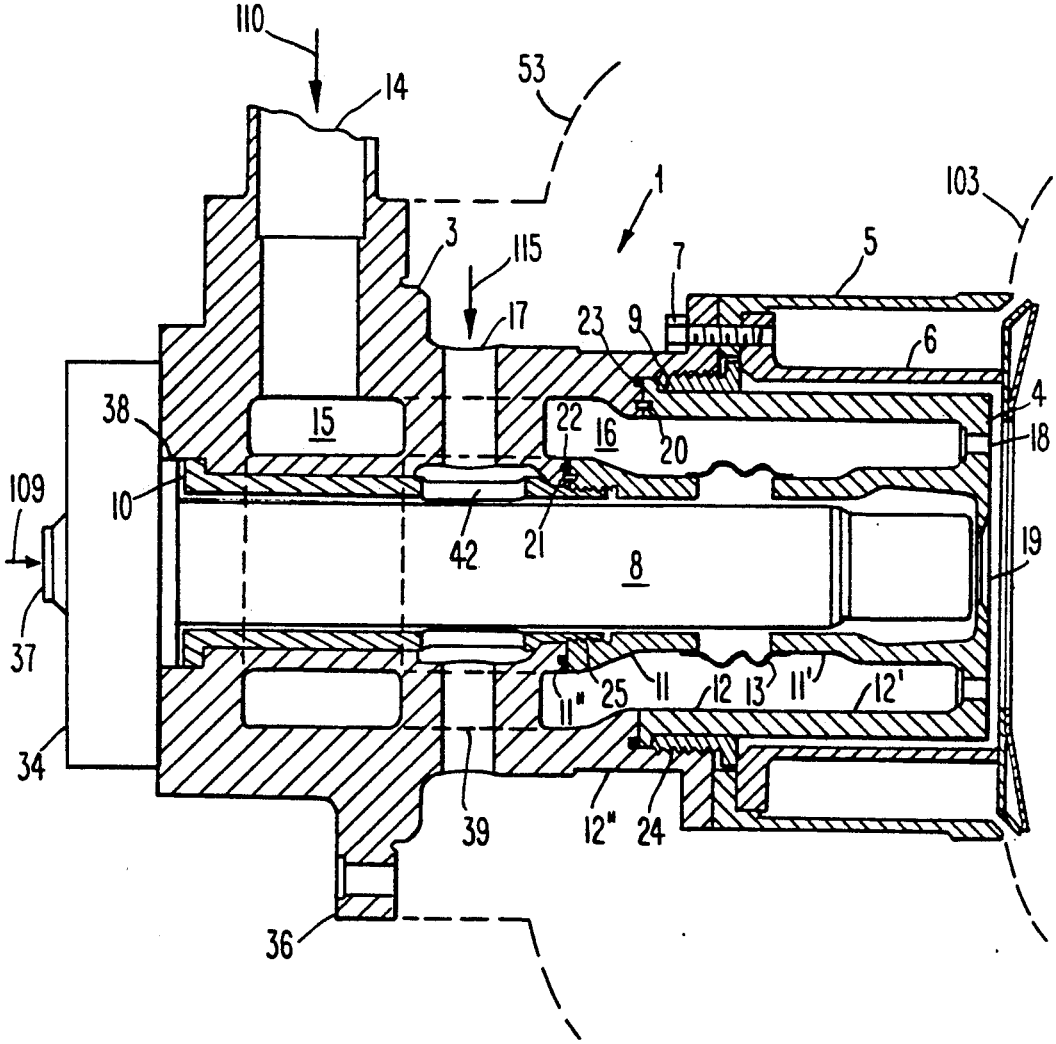
FIG. 2 is a cross-section through a dual gas/oil fuel nozzle assembly having a replaceable cap according to the current invention.

FIG. 2, shows a dual gas/oil fuel nozzle assembly 1 with a removable gas/oil nozzle cap 4 according to the current invention. In addition to the nozzle cap 4, the nozzle assembly 1 is comprised of a nozzle base 3, an oil spray nozzle 34, a swirl plate 6 and a ring 5. The nozzle base 3 has a flange 36 formed thereon by which it is secured, via screws (not shown), to the cylinder 53 that encloses the combustors 103. In addition, the nozzle base features a gas fuel inlet port 14 and a port 38 through which the oil spray nozzle 34, which may be of the conventional type, extends into a central chamber 8.

In operation, gas fuel 110 enters the gas inlet port 14 in the nozzle base 3 and flows into a manifold 15 that distributes the gas to a number of passages 39. From the passages 39, the gas flows through an annular passage 16 to a plurality of gas fuel outlet ports 18 arranged around the face of the nozzle cap 4. The gas fuel outlet ports 18 serve to inject the gas 110 into the compressed air 108 in the combustor 103. Oil fuel 109 enters the oil spray nozzle 34 through a inlet port 37. The oil spray nozzle 34 sprays the oil fuel into the compressed air through an oil fuel outlet port 19 in the face of the nozzle cap 4.

Oil fuel nozzles are subject to coking at the outlet port 19. Thus, in addition to the oil 109 and gas 110 fuel, cooling air 115, drawn from the compressor discharge air 108, is also supplied to the fuel nozzle assembly 1. Specifically, radially extending cooling air passages 17 are arranged around the nozzle base 3. The inlets of these passages are in flow communication with the compressed air entering the combustor 103. From the passages 17 the cooling air is directed, via openings 42 in a locking tube 10, discussed further below, to the central chamber 8 in which the oil spray nozzle 34 is disposed. The cooling air 115 flows along the annular space between an inner sleeve 11 and the oil spray nozzle 34 and then exits the nozzle via the oil fuel outlet port 19. By washing over the tip of the oil spray nozzle 34 and flowing through the oil fuel outlet port 19, the cooling air 115 prevents coking.

Figure 3:
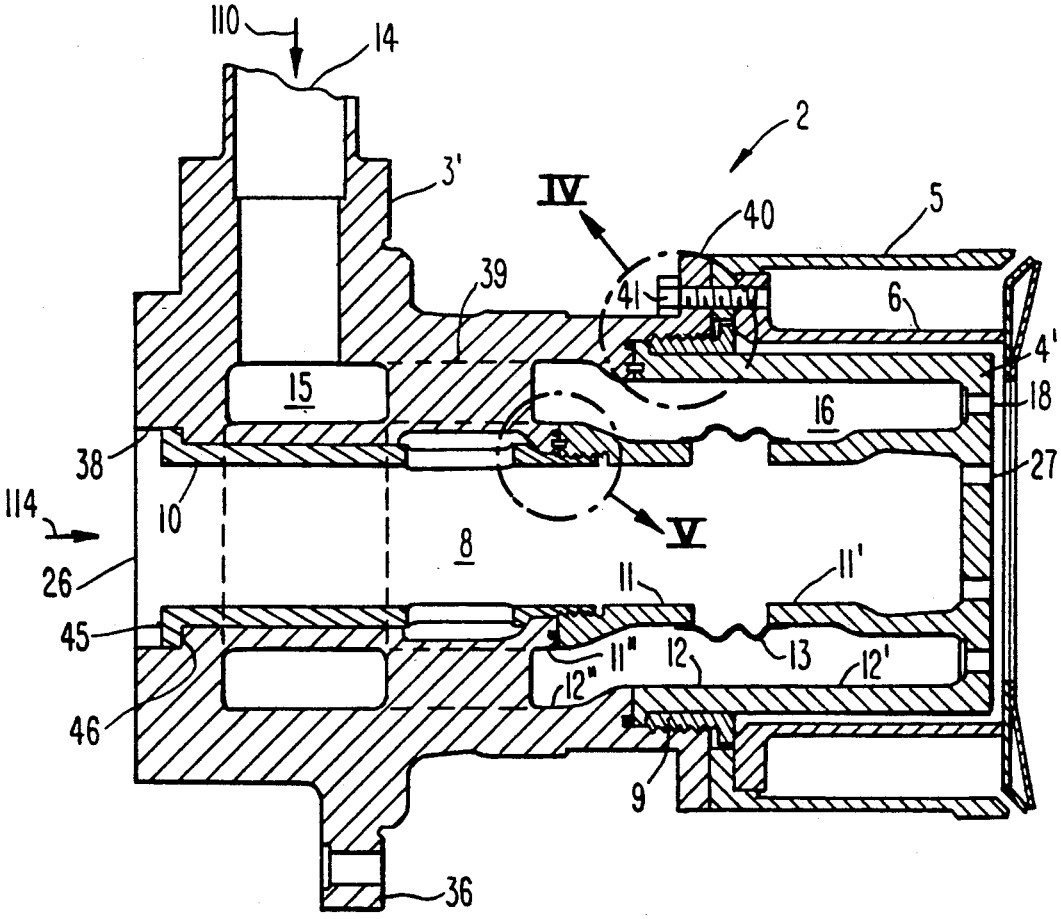
FIG. 3 is a cross-section through a gas fuel nozzle assembly, with steam injection capability, and having a replaceable cap according to the current invention.

FIG. 3 shows a gas fuel nozzle assembly 2, incorporating the capability of steam injection, and having a removable gas/steam nozzle cap 4', according to the current invention. The gas/steam nozzle assembly 2 is essentially identical to the gas/oil nozzle assembly 1 shown in FIG. 1 except for the absence of the oil spray nozzle 34, the cooling air passages 17 and the oil outlet port 19, and the addition of steam outlet ports 27 arranged around the face of the nozzle cap 4'.

In operation, gas fuel 110 enters the gas inlet port 14 in the nozzle base 3' and—via manifold 15, passages 39 and annular passage 16—flows to the gas fuel outlet ports 18, as before. Steam 114 enters the nozzle base 3 through inlet port 38 and then flows through the central chamber 8 to the steam outlet ports 27. The steam outlet ports 27 serve to inject the steam 114 into the hot gas in the combustor 103, thereby reducing the formation of NOx.

As shown in FIG. 3, the annular gas fuel passage 16 is formed between inner and outer concentric sleeves 11 and 12, respectively. The outer sleeve 12 is comprised of a front portion 12' that extends rearwardly from the nozzle cap 4, and a mating rear portion 12'' that extends forwardly from the nozzle base 3'. A flange 40 is formed on the outer sleeve rear portion 12'' for installing the swirl plate 6 and ring 5 via screws 41.

Similarly, the inner sleeve 11 is comprised of a front portion 11' that extends rearwardly from the nozzle cap 4' and a mating rear portion 11'' that extends forwardly from the nozzle base 3'. An expansion joint 13—comprised of a metal expansion bellows—is formed within the front portion 11' of the inner sleeve 11. The expansion bellows 13 reduces the stress on the inner sleeve 11 due to differential thermal expansion between the inner 11 and outer 12 sleeves. As also shown in FIG. 3, the central chamber 8 is formed within the inner sleeve 11.

As previously discussed, it would be very advantageous to be able to readily replace the nozzle cap without the need to cut through the inner and outer sleeves 11 and 12, respectively, connecting the nozzle cap to the nozzle base. However, the relatively complex arrangement of the fuel nozzle assemblies shown in FIGS. 2 and 3, along with the flexibility provided by the expansion joint 13 and the limited access available to the nozzle internals, precludes the use of a single threaded joint fastening the nozzle cap to the nozzle base.

As discussed further below, in the current invention, this problem is solved by parting the nozzle cap from the nozzle base along two separate joints—one in the inner sleeve and the other in the outer sleeve. Each joint being secured by a threaded locking member. The limited access available to the nozzle internals is dealt with by using an outer locking nut 9 and an inner locking tube 10. The outer locking nut 9 is installed from the front of the nozzle assembly and presses the mating portions of the outer sleeve joint together. The inner locking tube 10 is installed from the rear of the nozzle assembly and pulls the mating portions of the inner sleeve joint together. Although the detailed explanation of the invention below is made with reference to the gas/steam nozzle assembly 2 shown in FIG. 3, it should be understood that the description is equally applicable to the gas/oil nozzle 1 shown in FIG. 2.

Thus, as shown in FIG. 3, according to the current invention, the nozzle cap 4' is made readily replaceable by means of couplings that detachably couple the front and rear portions of the inner 11 and outer 12 sleeves together. Specifically, as shown best in FIG. 4, the front 12' and rear 12'' portions of the outer sleeve 12 are coupled together by the locknut 9. The locknut 9 has male threads that mate with female threads formed in the outer sleeve rear portion 12'' to form a threaded joint 24. The locknut 9 presses a flange 43 formed in the rear face of the outer sleeve front portion 12' against a front face 44 machined in the outer sleeve rear portion 12'', thereby forming a first secure, but detachable, joint between the nozzle cap 4' and the nozzle base 3'.

Figure 4:
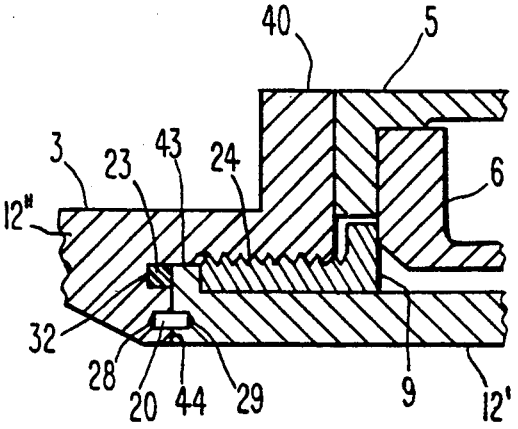
FIG. 4 is a detailed view of the portion of FIG. 2 indicated by the circle IV, except that the screw 41 and the holes through which it extends have been deleted for clarity.

As shown in FIG. 4, the outer sleeve 12 joint also features a seal 23—which may be a compressible high temperature gasket—that is disposed within a groove formed in the face 44. The seal 23 prevents gas fuel 110 flowing within the annular passage 16 from leaking into the compressed air surrounding the fuel nozzle assembly 2.

In addition, the outer sleeve 12 joint features anti-rotation pins 20 that extend through aligned holes 28 and 29 in the face 44 of the outer sleeve rear portion 12″ and the flange 43 in outer sleeve front portion 12′, respectively. The anti-rotation pins 20 ensure that friction between the locknut 9 and the flange 43 does not cause the outer sleeve front portion 12′ to rotate when the locknut is being tightened, since such rotation can impose a torque on the inner sleeve that could damage the expansion joint 13. In addition, the anti-rotation pins 20 ensure that the angular orientation of the gas and steam outlet ports 18 and 27, respectively, around the nozzle longitudinal axis is uniform for each fuel nozzle assembly, thereby maximizing uniformity in the combustion gas around the combustion system.

Figure 5:
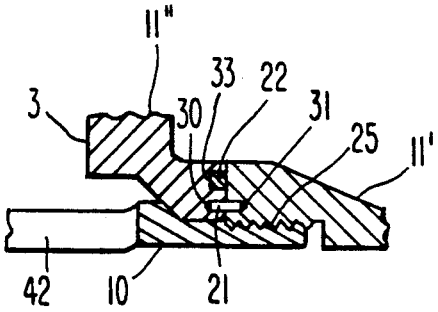
FIG. 5 is a detailed view of the portion of FIG. 2 indicated by the circle V.

As a result of the expansion joint 13, the locknut for the outer sleeve 12 is not capable of transmitting a force that would press the front 11′ and rear 11″ portions of the inner sleeve 11 together. Consequently, as shown best in FIG. 5, the lock tube 10 is utilized to form a second threaded joint 25. The lock tube 10 has a flange formed at its rear end that mates with a shoulder 46 formed in the port 38 in the nozzle base 3′. In addition, the lock tube 10 has male threads formed on its front end that mate with female threads formed at the rear end of the inner sleeve front portion 11′. By engaging the inner sleeve front portion 11′ in this manner, the lock tube 10 pulls the inner sleeve front portion 11′ against the rear portion 11″, thereby effecting a second secure, but detachable, joint between the nozzle cap 4′ and the nozzle base 3′.

As in the outer sleeve 12 joint, the inner sleeve 11 joint features a seal 22—which may be a compressible high temperature gasket—that is disposed within a groove formed in the front face of the inner sleeve rear portion 11″. The seal 22 prevents communication between the annular gas passage 16 and the central chamber 8, thereby ensuring that gas fuel 110 does not enter the steam flow 114, in the case of a gas/steam nozzle 2, or that gas fuel does not enter the cooling air 115, in the case of a gas/oil nozzle 1. In addition, the inner sleeve 11 joint features anti-rotation pins 21 that extend through aligned holes 30 and 31 in the front face of the inner sleeve rear portion 11″ and the rear face of the inner sleeve front portion 11′, respectively. The anti-rotation pins 21 ensure that the inner sleeve front portion 11′ is secured against rotation so that the lock tube 10 can be tightened.

When, after a period of operation, the nozzle cap 4′ requires replacement, the nozzle assembly 2 need only be removed from the combustion system and, after removing the swirl plate 6 and the ring 5, the lock nut 9 and lock tube 10 removed to separate the old nozzle cap 4′ from the base 3′ so that a new nozzle cap can be installed on the base.

Although the current invention has been discussed by reference to oil/gas and gas/steam fuel nozzles, the invention is equally applicable to other types of nozzles, particularly those adapted to inject more than one fluid into the combustion system. Accordingly, the current invention may be embodied in other specific forms without departing from the spirit or essential attributes thereof and, accordingly, reference should be made to the appended claims, rather than to the foregoing specification, as indicating the scope of the invention.

What is claimed is:

1. A gas turbine, comprising:
   a) a compressor for producing compressed air;
   b) a combustion system for heating said compressed air by fuel therein, thereby producing a heated compressed gas;
   c) a fuel nozzle assembly for introducing fuel into said combustion system, having:
      (i) a nozzle base having means for securing said nozzle assembly to said combustion system,
      (ii) a one piece nozzle cap having a first fluid outlet port formed therein for injecting a fluid into said compressed air, said nozzle cap having integral inner and outer rearwardly extending sleeves,
      (iii) means, separate from said nozzle cap and said nozzle base, for coupling and uncoupling said nozzle base from said nozzle cap, said coupling means having first and second means for attaching and detaching said nozzle base from said inner and outer sleeves, respectively, said first attaching and detaching means having means for engaging said inner sleeve and said nozzle base, said second attaching and detaching means having means for engaging said outer sleeve and said nozzle base; and
   d) a turbine for expanding said heated compressed gas from said combustor assembly.

2. The gas turbine according to claim 1, wherein said first and second attaching and detaching means comprise first and second threaded members, respectively.

3. The gas turbine according to claim 2, wherein said first threaded member has means for pulling said inner sleeve against said nozzle base.

4. The gas turbine according to claim 3, wherein said nozzle base has a rear face in which a passage is formed, and wherein said pulling means comprises a locking tube having means for engaging said nozzle base rear face and extending into said passage to engage said inner sleeve.

5. The gas turbine according to claim 3, wherein said second threaded member has means for pressing said outer sleeve against said nozzle base.

6. The gas turbine according to claim 5, wherein said pressing means comprises a locking nut.

7. The gas turbine according to claim 1, wherein said coupling and uncoupling means comprises means for preventing rotation of said nozzle cap relative to said nozzle base.

8. The gas turbine according to claim 7, wherein said rotation preventing means comprises a pin extending between said nozzle cap and said nozzle base.

9. The gas turbine according to claim 7, wherein said rotation preventing means comprises:
   a) a first pin extending between said inner sleeve and said nozzle base; and
   b) a second pin extending between said outer sleeve and said nozzle base.

10. The gas turbine according to claim 9, wherein said inner sleeve comprises means for accommodating differential thermal expansion between said inner and outer sleeves.

11. The gas turbine according to claim 1, wherein said coupling and uncoupling means further comprises first and second seals disposed between said nozzle base and said inner and outer sleeves, respectively.

12. The gas turbine according to claim 1, wherein:

a) said nozzle base has a first fluid inlet port; and b) said inner and outer sleeves form an annular passage therebetween placing said first fluid inlet port in flow communication with said first fluid outlet port.

13. The gas turbine according to claim 12, wherein:

a) said nozzle base has a second fluid inlet port;

b) said nozzle cap has a second fluid outlet port; and c) said inner sleeve forms a chamber therein placing said second fluid inlet port in flow communication with said second fluid outlet port.

14. In a gas turbine having a combustion system for heating a compressed gas by burning fuel therein, a fuel nozzle assembly for introducing said fuel into said combustion system, comprising:

a) a nozzle base having means for securing said fuel nozzle assembly to said combustion system, said nozzle base having first and second fluid inlet ports formed therein;

b) an integral nozzle cap having first and second fluid outlet ports formed therein;

c) inner and outer sleeves connecting said nozzle cap to said nozzle base, said inner and outer sleeves each having first and second portions, said inner and outer sleeve first portions extending from said nozzle base, said inner and outer sleeve second portions extending integrally from said nozzle cap;

d) a first threaded member having means for coupling and uncoupling said first outer sleeve portion from said second outer sleeve portion, said first threaded member having means for engaging said first and second outer sleeve portions; and e) a second substantially annular threaded member having means for coupling and uncoupling said first inner sleeve portion from said second inner sleeve portion, said second threaded member having means for engaging said second inner sleeve portion and said nozzle base.

15. The fuel nozzle assembly according to claim 14, wherein:

a) said inner and outer sleeves form an annular passage therebetween placing said first fluid inlet port in flow communication with said first fluid outlet port; and b) said inner sleeve forms a chamber therewithin, said second fluid outlet port disposed in said chamber.

16. The fuel nozzle assembly according to claim 15, wherein said second threaded member extends into said chamber.

17. The fuel nozzle assembly according to claim 16, wherein said second threaded member has a first end adapted to engage said nozzle base and a second end adapted to engage said inner sleeve second portion, whereby said second threaded member couples said first and second portions of said inner sleeve by pulling said inner sleeve second portion toward said inner sleeve first portion.

18. The fuel nozzle assembly according to claim 17, wherein said first threaded member has means for pressing said outer sleeve second portion against said outer sleeve first portion.

19. In a gas turbine having a combustion system for heating a compressed gas by burning fuel therein, a fuel nozzle assembly for introducing said fuel into said combustion system, comprising:

a) a nozzle base having a fluid inlet port for receiving fuel for said fuel nozzle assembly and a rear face, a passage formed in said nozzle base and extending forwardly from said rear face;

b) a integral nozzle cap having a fluid outlet port formed therein, said nozzle cap having integral inner and outer rearwardly extending sleeves, said inner sleeve having a threaded portion formed thereon;

c) an outer locking member for coupling and uncoupling said outer sleeve to said nozzle base, said outer locking member having a threaded portion adapted to press said outer sleeve against said nozzle base; and d) an inner locking member for coupling and uncoupling said inner sleeve to said nozzle base, said inner locking member engaging said nozzle base rear face and extending forwardly into said passage, said inner locking member having a threaded portion adapted to mate with said inner sleeve threaded portion so as to pull said inner sleeve against said nozzle base.

* * * * *